US009123325B2

(12) United States Patent
Iseki et al.

(10) Patent No.: US 9,123,325 B2
(45) Date of Patent: Sep. 1, 2015

(54) ACTIVE VIBRATION NOISE CONTROL DEVICE

(75) Inventors: Akihiro Iseki, Kawasaki (JP); Yoshiki Ohta, Sakado (JP); Yoshitomo Imanishi, Fujimi (JP); Kensaku Obata, Kawasaki (JP)

(73) Assignee: PIONEER CORPORATION, Kanagawa (JP)

( * ) Notice: Subject to any disclaimer, the term of this patent is extended or adjusted under 35 U.S.C. 154(b) by 254 days.

(21) Appl. No.: 13/578,727

(22) PCT Filed: Feb. 15, 2010

(86) PCT No.: PCT/JP2010/052141

§ 371 (c)(1),
(2), (4) Date: Aug. 13, 2012

(87) PCT Pub. No.: WO2011/099152

PCT Pub. Date: Aug. 18, 2011

(65) Prior Publication Data

US 2012/0300955 A1 Nov. 29, 2012

(51) Int. Cl.
*G10K 11/178* (2006.01)
*H04R 3/02* (2006.01)

(52) U.S. Cl.
CPC ..... *G10K 11/1786* (2013.01); *H04R 3/02* (2013.01); *G10K 2210/12821* (2013.01)

(58) Field of Classification Search
CPC ..... F02B 27/001; G10K 11/1786; G10K 11/1788; G10K 2210/121; G10K 2210/1281; G10K 2210/1282; G10K 2210/12822; G10K 2210/3046; H04R 3/02
USPC ..... 381/71.1–71.14
See application file for complete search history.

(56) References Cited

U.S. PATENT DOCUMENTS

| | | | | |
|---|---|---|---|---|
| 5,267,320 | A * | 11/1993 | Fukumizu | 381/71.12 |
| 2003/0016833 | A1* | 1/2003 | Harvey | 381/71.5 |
| 2005/0053244 | A1* | 3/2005 | Onishi et al. | 381/71.11 |
| 2010/0290635 | A1* | 11/2010 | Shridhar et al. | 381/71.1 |

FOREIGN PATENT DOCUMENTS

| | | |
|---|---|---|
| JP | 06-332477 | 12/1994 |
| JP | 8-339191 | 12/1996 |
| JP | 2005-084500 | 3/2005 |

OTHER PUBLICATIONS

International Search Report, PCT/JP2010/052141, Apr. 20, 2010.

* cited by examiner

*Primary Examiner* — Davetta W Goins
*Assistant Examiner* — Daniel Sellers
(74) *Attorney, Agent, or Firm* — Young & Thompson

(57) ABSTRACT

An active vibration noise control device cancels vibration noise by making plural speakers generate control sounds. The active vibration noise control device selects one or more speakers which output the control sounds, from plural speakers, based on a relationship between (1) a first phase difference which corresponds to a difference between phase characteristics of the vibration noise from a vibration noise source to an evaluation point and phase characteristics of the vibration noise from the vibration noise source to a pseudo evaluation point and (2) a second phase difference for each of the plural speakers corresponding to a difference between phase characteristics of the control sound from the speaker to the evaluation point and phase characteristics of the control sound from the speaker to the pseudo evaluation point. Therefore, it stably decreases the vibration noise at the pseudo evaluation point independently of a frequency band of the vibration noise.

18 Claims, 11 Drawing Sheets

P_n = −40 DEGREES
P_FL = 0 DEGREES
P_FR = −50 DEGREES
P_RL = 30 DEGREES
P_RR = 25 DEGREES

ACTIVE VIBRATION NOISE CONTROL DEVICE

TECHNICAL FIELD

The present invention relates to a technical field for actively controlling a vibration noise by using an adaptive notch filter.

BACKGROUND TECHNIQUE

Conventionally, there is proposed an active vibration noise control device for controlling an engine sound heard in a vehicle interior by a controlled sound output from a speaker so as to decrease the engine sound at a position of passenger's ear. For example, noticing that a vibration noise in a vehicle interior is generated in synchronization with a revolution of an output axis of an engine, there is proposed a technique for canceling the noise in the vehicle interior on the basis of the revolution of the output axis of the engine by using an adaptive notch filter so that the vehicle interior becomes silent.

In addition, there is proposed a technique for decreasing the vibration noise at a position (for example, ear position) other than an installation position of the microphone (see Patent References 1 and 2, for example). Concretely, in Patent Reference-2, there is proposed a technique for correcting an output signal from one speaker by using a filter coefficient in order to prevent an interference of control sounds from plural speakers, which sometimes occurs by the technique described in Patent Reference-1.

PRIOR ART REFERENCE

Patent Reference

Patent Reference-1: Japanese Patent Application Laid-open under No. 06-332477

Patent Reference-2: Japanese Patent Application Laid-open under No. 2005-84500

DISCLOSURE OF INVENTION

Problem to be Solved by the Invention

However, by the technique described in Patent Reference-2, since a filter coefficient F of a compensating filter is calculated by an equation "$F=(c01-q\cdot c00)/(q\cdot c10-c11)$", there is a case that the filter coefficient F becomes unstable depending on a frequency band. Concretely, when a denominator of the equation for calculating the filter coefficient F becomes small, the filter coefficient F tends to become unstable. Therefore, by the technique described in Patent Reference-2, there is a possibility that the active vibration noise control device performs an unusual operation depending on the frequency band due to a divergence of the error signal.

The present invention has been achieved in order to solve the above problem. It is an object of the present invention to provide an active vibration noise control device which can stably decrease a vibration noise at a position other than an installation position of a microphone independently of a frequency band.

Means for Solving the Problem

In the invention according to claim 1, an active vibration noise control device for canceling a vibration noise by making plural speakers output control sounds, includes: a basic signal generating unit which generates a basic signal based on a vibration noise frequency generated by a vibration noise source; an adaptive notch filter which generates control signals provided to each of the plural speakers by applying a filter coefficient to the basic signal, in order to make the plural speakers generate the control sounds so that the vibration noise generated by the vibration noise source is canceled; a microphone which detects a cancellation error between the vibration noise and the control sound, and outputs an error signal; a reference signal generating unit which generates a reference signal from the basic signal based on transfer functions from the plural speakers to the microphone; a filter coefficient updating unit which updates the filter coefficient used by the adaptive notch filter based on the error signal and the reference signal so as to minimize the error signal; and a controlling unit which selects one or more speakers from the plural speakers, and makes only the selected one or more speakers output the control sounds, wherein the controlling unit selects one or more speakers from the plural speakers, based on a relationship between (1) a first phase difference which corresponds to a difference between phase characteristics of the vibration noise from the vibration noise source to an evaluation point corresponding to an installation position of the microphone and phase characteristics of the vibration noise from the vibration noise source to a pseudo evaluation point corresponding to a different position from the installation position and (2) a second phase difference for each of the plural speakers which corresponds to a difference between phase characteristics of the control sound from the speaker to the evaluation point and phase characteristics of the control sound from the speaker to the pseudo evaluation point.

DETAILED DESCRIPTION OF THE PREFERRED EMBODIMENTS

Figure 1:
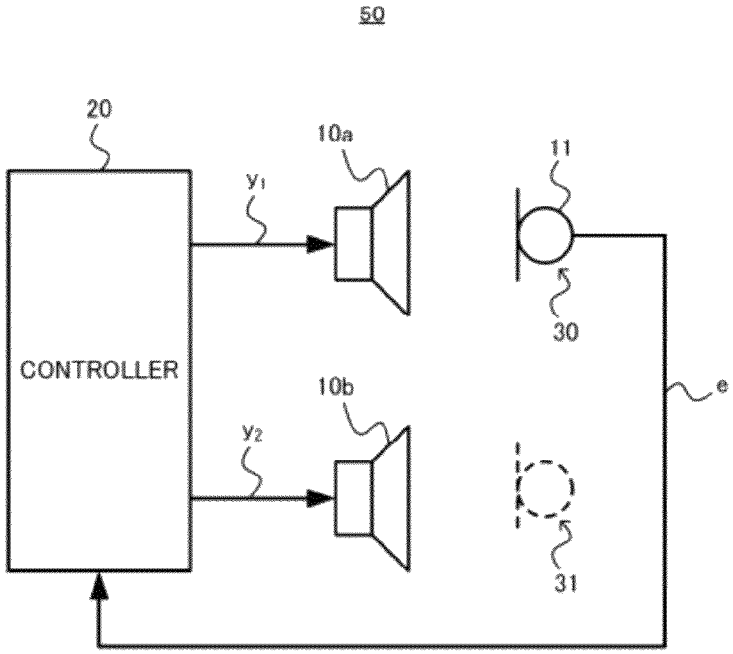
FIG. 1 shows a schematic configuration of an active vibration noise control device in an embodiment.

According to one aspect of the present invention, there is provided an active vibration noise control device for canceling a vibration noise by making plural speakers output control sounds, including: a basic signal generating unit which generates a basic signal based on a vibration noise frequency generated by a vibration noise source; an adaptive notch filter which generates control signals provided to each of the plural speakers by applying a filter coefficient to the basic signal, in order to make the plural speakers generate the control sounds so that the vibration noise generated by the vibration noise source is canceled; a microphone which detects a cancellation error between the vibration noise and the control sound, and outputs an error signal; a reference signal generating unit which generates a reference signal from the basic signal based on transfer functions from the plural speakers to the microphone; a filter coefficient updating unit which updates the filter coefficient used by the adaptive notch filter based on the error signal and the reference signal so as to minimize the error signal; and a controlling unit which selects one or more speakers from the plural speakers, and makes only the selected one or more speakers output the control sounds, wherein the controlling unit selects one or more speakers from the plural speakers, based on a relationship between (1) a first phase difference which corresponds to a difference between phase characteristics of the vibration noise from the vibration noise source to an evaluation point corresponding to an installation position of the microphone and phase characteristics of the vibration noise from the vibration noise source to a pseudo evaluation point corresponding to a different position from the installation position and (2) a second phase difference for each of the plural speakers which corresponds to a difference between phase characteristics of the control sound from the speaker to the evaluation point and phase characteristics of the control sound from the speaker to the pseudo evaluation point.

The above active vibration noise control device is preferably used for canceling the vibration noise (for example, vibration noise from engine) by making the plural speakers generate the control sounds. The basic signal generating unit generates the basic signal based on the vibration noise frequency generated by the vibration noise source. The adaptive notch filter generates the control signals provided to the plural speakers by applying the filter coefficient to the basic signal. The microphone detects the cancellation error between the vibration noise and the control sound, and outputs the error signal. The reference signal generating unit generates the reference signal from the basic signal based on the transfer functions from the speakers to the microphone. The filter coefficient updating unit updates the filter coefficient used by the adaptive notch filter so as to minimize the error signal. Then, the controlling unit selects one or more speakers from the plural speakers, and makes only the selected one or more speakers output the control sounds. Namely, the controlling unit selects one or more speakers which output the control sounds so as to determine an arrangement condition of the speakers. Concretely, the controlling unit selects one or more speakers from the plural speakers, based on the relationship between (1) the first phase difference which corresponds to the difference between the phase characteristics of the vibration noise from the vibration noise source to the evaluation point and the phase characteristics of the vibration noise from the vibration noise source to the pseudo evaluation point and (2) the second phase difference for each of the plural speakers which corresponds to the difference between the phase characteristics of the control sound from the speaker to the evaluation point and the phase characteristics of the control sound from the speaker to the pseudo evaluation point. Therefore, it becomes possible to stably decrease the vibration noise at the pseudo evaluation point independently of the frequency band of the vibration noise.

In another manner of the above active vibration noise control device, the controlling unit selects at least one speaker having such a second phase difference that an absolute value of a difference from the first phase difference is equal to or smaller than a predetermined value, from the plural speakers. Therefore, since the phase characteristics of the control sound of the speaker appropriately approximate the phase characteristics of the vibration noise, it becomes possible to effectively decrease the vibration noise at the pseudo evaluation point.

In another manner of the above active vibration noise control device, the controlling unit selects at least one speaker having the second phase difference being larger than the first phase difference, and selects at least one speaker having the second phase difference being smaller than the first phase difference, from the plural speakers. Therefore, since the phase characteristics of the control sound of the speaker appropriately approximate the phase characteristics of the vibration noise, it becomes possible to effectively decrease the vibration noise at the pseudo evaluation point, too.

In a preferred example of the above active vibration noise control device, the controlling unit can select at least one speaker having the second phase difference closest to the first phase difference, from the plural speakers.

In another manner of the above active vibration noise control device, the controlling unit changes the speaker to be selected, in accordance with a frequency band of the vibration noise. In the manner, the controlling unit can select the speakers which output the control sounds, in consideration of such a tendency that the first phase difference and the second phase difference change depending on the frequency band of the vibration noise.

In another manner of the above active vibration noise control device, further including, an amplitude controlling unit which controls an amplitude of the control signal of the speaker selected by the controlling unit, based on the first phase difference and the second phase difference of the speaker selected by the controlling unit. Preferably, so that the second phase difference of a control sound obtained by combining control sounds of plural speakers selected by the controlling unit approaches the first phase difference, the amplitude controlling unit controls the amplitude of the control signals of each of the said plural speakers. Therefore, the second phase difference of the control sound obtained by combining the control sounds of the selected plural speakers effectively approximates the first phase difference of the vibration noise. Hence, it becomes possible to decrease the vibration noise at the pseudo evaluation point more effectively.

EMBODIMENT

Preferred embodiments of the present invention will be explained hereinafter with reference to the drawings.

[Basic Concept]

First, a description will be given of a basic concept of an embodiment. Here, an active vibration noise control device 50 shown in FIG. 1 will be explained as an example.

FIG. 1 shows a schematic configuration of the active vibration noise control device 50 in the embodiment. The active vibration noise control device 50 mainly includes speakers 10*a* and 10*b*, a microphone 11 and a controller 20.

Basically, the active vibration noise control device 50 generates control sounds from the speakers 10*a* and 10*b* based on a vibration noise frequency in order to decrease the vibration noise at an installation position 30 of the microphone 11. Hereinafter, the position is referred to as "evaluation point".

The evaluation point 30 corresponds to a controlling point. For example, the active vibration noise control device 50 is mounted on a vehicle, and performs a process for decreasing the vibration noise of an engine. Concretely, the active vibration noise control device 50 generates control signals $y_1$ and $y_2$ for minimizing an error by feeding back an error signal detected by the microphone 11, and makes the speakers 10*a* and 10*b* output the control sounds corresponding to the control signals $y_1$ and $y_2$.

Additionally, the active vibration noise control device 50 performs the above process for decreasing the vibration noise at the evaluation point 30, and performs a process for decreasing the vibration noise at a different position 31 (hereinafter referred to as "pseudo evaluation point") from the installation position of the microphone 11. Concretely, in consideration of characteristics of the vibration noise source, the active vibration noise control device 50 performs the process for decreasing the vibration noise at the pseudo evaluation point 31. For example, the pseudo evaluation point 31 is a user's ear position.

Figure 2:
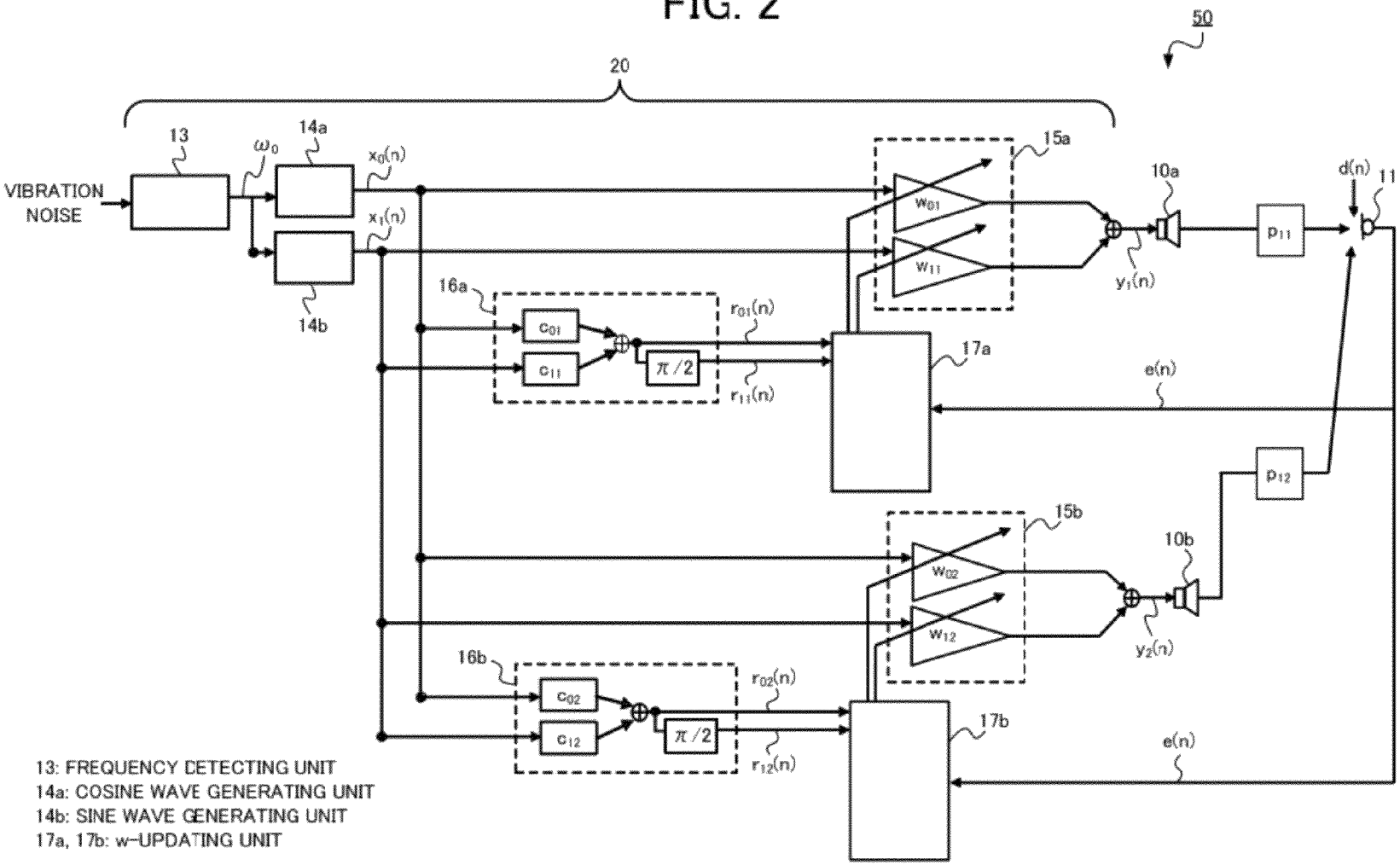
FIG. 2 is a block diagram showing a configuration of an active vibration noise control device in an embodiment.

Next, a description will be given of a concrete configuration of the above active vibration noise control device 50 in the embodiment, with reference to FIG. 2. FIG. 2 is a block diagram showing an example of the configuration of the active vibration noise control device 50.

The active vibration noise control device 50 includes speakers 10*a* and 10*b*, a microphone 11, a frequency detecting unit 13, a cosine wave generating unit 14*a*, a sine wave generating unit 14*b*, adaptive notch filters 15*a* and 15*b*, reference signal generating units 16*a* and 16*b* and w-updating units 17*a* and 17*b*. The frequency detecting unit 13, the cosine wave generating unit 14*a*, the sine wave generating unit 14*b*, the adaptive notch filters 15*a* and 15*b*, the reference signal generating units 16*a* and 16*b* and the w-updating units 17*a* and 17*b* correspond to the above controller 20. Hereinafter, when it is not necessary to distinguish the components for which "a" is applied to the reference numeral from the components for which "b" is applied to the reference numeral, "a" and "b" are suitably omitted.

The frequency detecting unit 13 is supplied with the vibration noise (for example, engine pulse) and detects a frequency $\omega_0$ of the vibration noise. Then, the frequency detecting unit 13 supplies the cosine wave generating unit 14*a* and the sine wave generating unit 14*b* with a signal corresponding to the frequency $\omega_0$.

The cosine wave generating unit 14*a* and the sine wave generating unit 14*b* generate a basic cosine wave $x_0(n)$ and a basic sine wave $x_1(n)$ which include the frequency $\omega_0$ detected by the frequency detecting unit 13. Concretely, as shown by equations (1) and (2), the cosine wave generating unit 14*a* and the sine wave generating unit 14*b* generate the basic cosine wave $x_0(n)$ and the basic sine wave $x_1(n)$. In the equations (1) and (2), "n" is natural number and corresponds to time (The same will apply hereinafter). Additionally, "A" indicates amplitude, and "φ" indicates an initial phase.

$$x_0(n)=A\cos(\omega_0 n+\phi) \tag{1}$$

$$x_1(n)=A\sin(\omega_0 n+\phi) \tag{2}$$

Then, the cosine wave generating unit 14*a* and the sine wave generating unit 14*b* supply the adaptive notch filters 15 and the reference signal generating units 16 with basic signals corresponding to the basic cosine wave $x_0(n)$ and the basic sine wave $x_1(n)$. Thus, the cosine wave generating unit 14*a* and the sine wave generating unit 14*b* correspond to an example of the basic signal generating unit.

The adaptive notch filters 15*a* and 15*b* perform the filter process of the basic cosine wave $x_0(n)$ and the basic sine wave $x_1(n)$, so as to generate the control signals $y_1(n)$ and $y_2(n)$ supplied to the speakers 10*a* and 10*b*. Concretely, the adaptive notch filter 15*a* generates the control signal $y_1(n)$ based on the filter coefficients $w_{01}(n)$ and $w_{11}(n)$ inputted from the w-updating unit 17*a*, and the adaptive notch filter 15*b* generates the control signal $y_2(n)$ based on the filter coefficients $w_{02}(n)$ and $w_{12}(n)$ inputted from the w-updating unit 17*b*. Specifically, as shown by an equation (3), the adaptive notch filter 15*a* adds a value obtained by multiplying the basic cosine wave $x_0(n)$ by the filter coefficient $w_{01}(n)$, to a value by multiplying the basic sine wave $x_1(n)$ by the filter coefficient $w_{11}(n)$, so as to calculate the control signal $y_1(n)$. Similarly, as shown by an equation (4), the adaptive notch filter 15*b* adds a value obtained by multiplying the basic cosine wave $x_0(n)$ by the filter coefficient $w_{02}(n)$, to a value by multiplying the basic sine wave $x_1(n)$ by the filter coefficient $w_{12}(n)$, so as to calculate the control signal $y_2(n)$.

$$y_1(n)=w_{01}(n)x_0(n)+w_{11}(n)x_1(n) \tag{3}$$

$$y_2(n)=w_{02}(n)x_0(n)+w_{12}(n)x_1(n) \tag{4}$$

The speakers 10*a* and 10*b* generate the control sounds corresponding to the control signals $y_1(n)$ and $y_2(n)$ inputted from the adaptive notch filters 15*a* and 15*b*, respectively. The control sounds generated by the speakers 10*a* and 10*b* are transferred to the microphone 11. Transfer functions from the speakers 10*a* and 10*b* to the microphone 11 are represented by "$p_{11}$" and "$p_{12}$", respectively. The transfer functions $p_{11}$ and $p_{12}$ are defined by frequency $\omega_0$, and depend on sound field characteristics and the distance from the speakers 10*a* and 10*b* to the microphone 11. For example, the transfer functions $p_{11}$ and $p_{12}$ are preliminarily set by a measurement in the vehicle interior.

The microphone 11 detects a cancellation error between the vibration noise and the control sounds generated by the speakers 10*a* and 10*b*, and supplies the w-updating units 17*a* and 17*b* with the cancellation error as the error signal e(n). Concretely, the microphone 11 outputs the error signal e(n) in accordance with the control signals $y_1(n)$ and $y_2(n)$, the transfer functions $p_{11}$ and $p_{12}$ and the vibration noise d(n).

The reference signal generating units 16*a* and 16*b* generate reference signals from the basic cosine wave $x_0(n)$ and the basic sine wave $x_1(n)$ based on the above transfer functions $p_{11}$ and $p_{12}$, and supplies the w-updating units 17*a* and 17*b* with the reference signals. Concretely, the reference signal generating unit 16*a* uses a real part $c_{01}$ and an imaginary part $c_{11}$ of the transfer function pH, and the reference signal generating unit 16*b* uses a real part $c_{02}$ and an imaginary part $c_{12}$ of the transfer function $p_{12}$. Specifically, the reference signal generating unit 16*a* adds a value obtained by multiplying the basic cosine wave $x_0(n)$ by the real part $c_{01}$ of the transfer function $p_{11}$, to a value obtained by multiplying the basic sine wave $x_1(n)$ by the imaginary part $c_{11}$ of the transfer function $p_{11}$, and outputs a value obtained by the addition as the reference signal $r_{01}(n)$. In addition, the reference signal generating unit 16*a* delays the reference signal $r_{01}(n)$ by "π/2", and outputs the delayed signal as the reference signal $r_{11}(n)$. Similarly, the reference signal generating unit 16*b* adds a value obtained by multiplying the basic cosine wave $x_0(n)$ by the real part $c_{02}$ of the transfer function $p_{12}$, to a value obtained by multiplying the basic sine wave $x_1(n)$ by the imaginary part $c_{12}$ of the transfer function $p_{12}$, and outputs a value obtained by the addition as the reference signal $r_{02}(n)$. In addition, the reference signal generating unit 16*b* delays the reference signal $r_{02}(n)$ by "n/2", and outputs the delayed signal as the reference signal $r_{12}(n)$. Thus, the reference signal generating units 16*a* and 16*b* correspond to an example of the reference signal generating unit.

The w-updating units 17*a* and 17*b* update the filter coefficients used by the adaptive notch filters 15*a* and 15*b* based on the LMS (Least Mean Square) algorism, and supplies the adaptive notch filters 15*a* and 15*b* with the updated filter coefficients. Concretely, the w-updating units 17*a* and 17*b* update the filter coefficients used by the adaptive notch filters 15*a* and 15*b* last time so as to minimize the error signal e(n), based on the error signal e(n) and the reference signals $r_{01}(n)$, $r_{11}(n)$, $r_{02}(n)$ and $r_{12}(n)$. Thus, the w-updating units 17*a* and 17*b* correspond to an example of the filter coefficient updating unit.

The filter coefficients before the update of the w-updating unit 17*a* are expressed as "$w_{01}(n)$" and "$w_{11}(n)$", and the filter coefficients after the update of the w-updating unit 17*a* are expressed as "$w_{01}(n+1)$" and "$w_{11}(n+1)$". As shown by equations (5) and (6), the filter coefficients after the update $w_{01}(n+1)$ and $w_{11}(n+1)$ are calculated.

$$w_{01}(n+1)=w_{01}(n)-\mu_1\cdot e(n)\cdot r_{01}(n) \tag{5}$$

$$w_{11}(n+1)=w_{11}(n)-\mu_1\cdot e(n)\cdot r_{11}(n) \tag{6}$$

Similarly, the filter coefficients before the update of the w-updating unit 17*b* are expressed as "$w_{02}(n)$" and "$w_{12}(n)$", and the filter coefficients after the update of the w-updating unit 17*b* are expressed as "$w_{02}(n+1)$" and "$w_{12}(n+1)$". As shown by equations (7) and (8), the filter coefficients after the update $w_{02}(n+1)$ and $w_{12}(n+1)$ are calculated.

$$w_{02}(n+1)=w_{02}(n)-\mu_2\cdot e(n)\cdot r_{02}(n) \tag{7}$$

$$w_{12}(n+1)=w_{12}(n)-\mu_2\cdot e(n)\cdot r_{12}(n) \tag{8}$$

In equations (5) to (8), "$\mu_1$" and "$\mu_2$" are coefficients called a step-size parameter for determining a convergence speed. In other words, "$\mu_1$" and "$\mu_2$" are coefficients related to an update rate of the filter coefficient. For example, preliminarily set values are used as the step-size parameters $\mu_1$ and $\mu_2$.

Though only two speakers 10*a* and 10*b* are shown in FIG. 1 and FIG. 2 as a matter of convenience, the active vibration noise control device 50 actually includes more than two speakers 10. Additionally, though FIG. 2 shows the diagram in which the adaptive notch filters 15*a* and 15*b*, the reference signal generating units 16*a* and 16*b* and the w-updating units 17*a* and 17*b* are separated, these components may be integrated.

Next, a description will be given of a problem of the above-mentioned conventional technique, with reference to FIGS. 3A to 3C. The conventional technique corresponds to the technique described in Patent Reference-2. Hereinafter, the technique is referred to as "comparative example". Basically, an active vibration noise control device in the comparative example performs a process for decreasing the vibration noise not only at the evaluation point but also at the pseudo evaluation point. Concretely, the active vibration noise control device in the comparative example corrects the output signal from one speaker by using the filter coefficient F, in order to prevent the interference of the control sounds from the plural speakers (two speakers). In this case, the active vibration noise control device calculates the filter coefficient F of the compensating filter by using the equation "F=(c01−q·c00)/(q·c10−c11)".

Figure 3A:
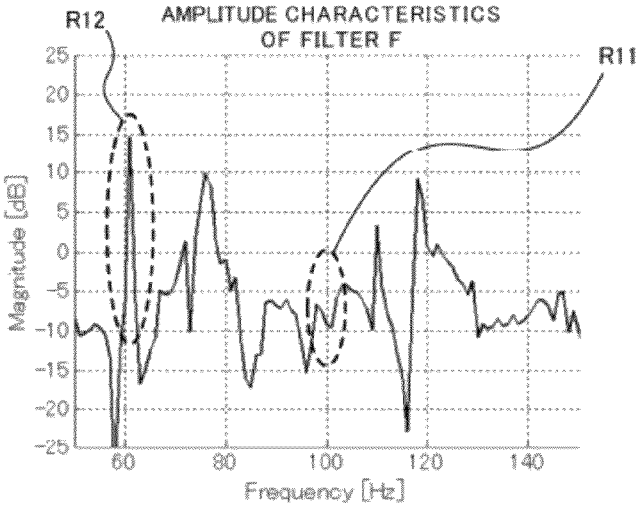
FIGS. 3A to 3C show diagrams for explaining a problem of a comparative example.
Figure 3B:
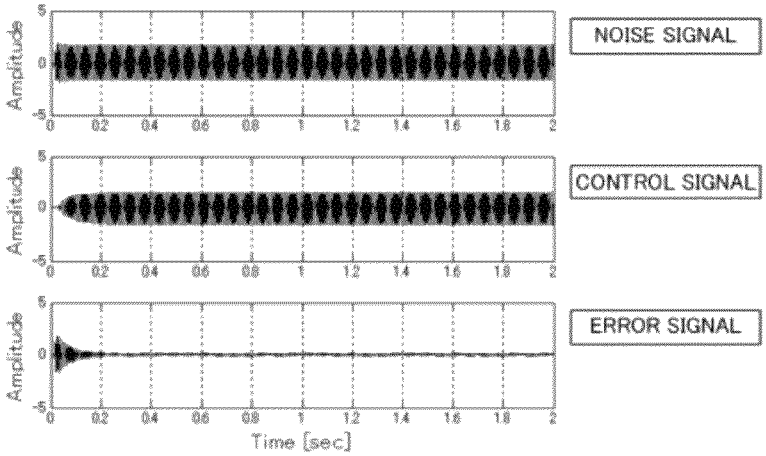
Figure 3C:
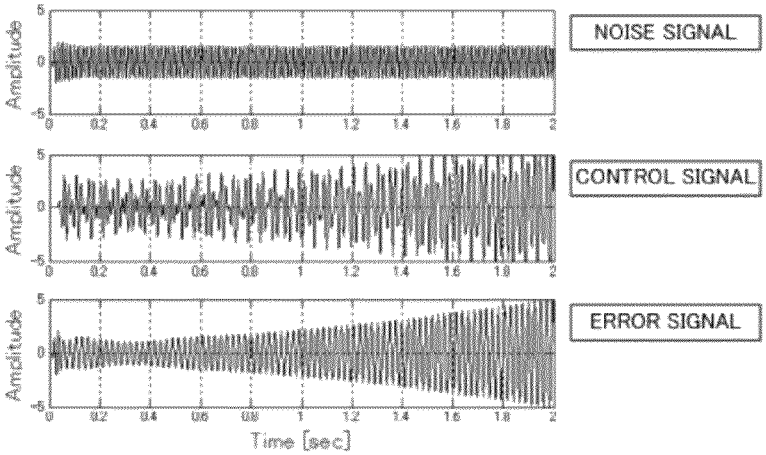

FIGS. 3A to 3C show result examples obtained by a simulation of the active vibration noise control device in the comparative example. Here, results in case of using transfer functions in the actual vehicle interior are shown. FIG. 3A shows an example of amplitude characteristics of the filter coefficient F. Concretely, a horizontal axis shows a frequency [Hz] of the vibration noise (in other words, noise signal. The same will apply hereinafter), and a vertical axis shows an amplitude (magnitude) [dB] of the filter coefficient F. As shown in FIG. 3A, when the frequency is 100 [Hz], for example, it can be understood that the filter coefficient F is stable (see a dashed area R11). In contrast, when the frequency is 61 [Hz], for example, it can be understood that the filter coefficient F is unstable (see a dashed area R12).

FIGS. 3B and 3C show examples of a reduction effect of the vibration noise at the evaluation point in case of using the active vibration noise control device in the comparative example. Concretely, FIG. 3B shows a result example when the frequency of the vibration noise is 100 [Hz], and FIG. 3C shows a result example when the frequency of the vibration noise is 61 [Hz]. Additionally, FIGS. 3B and 3C show time changes of a noise signal, a control signal and an error signal, in descending order. As shown in FIG. 3B, when the frequency is 100 [Hz], it can be understood that the error signal converges. Namely, it can be said that the vibration noise appropriately decreases. In contrast, as shown in FIG. 3C, when the frequency is 61 [Hz], it can be understood that the error signal diverges. Namely, it can be said that the vibration noise does not appropriately decrease.

Thus, according to the active vibration noise control device in the comparative example, it turns out that there is a possibility that the unusual operation of the active vibration noise control device occurs due to the divergence of the error signal, when the filter coefficient F becomes unstable depending on the frequency band. In the embodiment, the active vibration noise control device 50 performs the process for stably decreasing the vibration noise at the pseudo evaluation point 31 independently of the frequency band of the vibration noise, in order to solve the problem according to the comparative example.

Next, a description will be given of a basic concept of the process performed by the active vibration noise control device 50 in the embodiment, with reference to FIG. 4.

Figure 4:
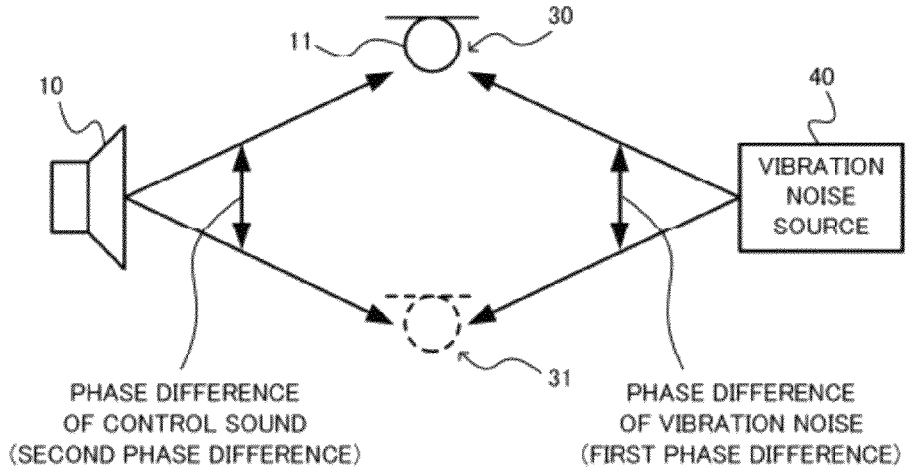
FIG. 4 shows a diagram for explaining a basic concept of an embodiment.

In FIG. 4, a phase difference of the vibration noise (hereinafter suitably referred to as "first phase difference") corresponds to a difference between phase characteristics of the vibration noise from the vibration noise source 40 to the evaluation point 30 and phase characteristics of the vibration noise from the vibration noise source 40 to the pseudo evaluation point 31. Additionally, a phase difference of the control sound (hereinafter suitably referred to as "second phase difference") corresponds to a difference between phase characteristics of the control sound from the speaker 10 to the evaluation point 30 and phase characteristics of the control sound from the speaker 10 to the pseudo evaluation point 31. When the first phase difference coincides with the second phase difference between the evaluation point 30 and the pseudo evaluation point 31, it is thought that the vibration noise at the pseudo evaluation point 31 decreases at the same time if the vibration noise at the evaluation point 30 decreases. Namely, it is thought that the vibration noise can stably decrease if the phase characteristics of the control sound of the speaker 10 approximate the phase characteristics of the vibration noise.

Therefore, the active vibration noise control device 50 in the embodiment performs the process in consideration of the first phase difference and the second phase difference between the evaluation point 30 and the pseudo evaluation point 31. Concretely, the active vibration noise control device 50 in the embodiment selects one or more speakers 10 from the plural speakers 10 based on a relationship between the first phase difference and the second phase differences of the plural speakers 10, and makes only the selected one or more speakers 10 output the control sounds. Namely, so that the second phase difference which approximates the first phase difference of the vibration noise is generated, the active vibration noise control device 50 selects one or more speakers 10 which output the control sounds, so as to determine an arrangement condition of the speakers 10. In other words, the active vibration noise control device 50 controls the second phase difference by changing the arrangement condition of the speakers 10, so that the second phase difference approximates the first phase difference.

Specifically, the active vibration noise control device 50 in the embodiment selects one or more speakers 10 having such a second phase difference that an absolute value of a difference from the first phase difference is equal to or smaller than a predetermined value, from the plural speakers 10. In this case, when there are plural speakers 10 having such a second phase difference that the absolute value of the difference from the first phase difference is equal to or smaller than the predetermined value, the active vibration noise control device 50 can select at least a speaker 10 having the second phase difference closest to the first phase difference.

The first phase difference and the second phase differences of the plural speakers 10 are preliminarily calculated by a measurement and/or a predetermined operational expression, and are stored in a memory. Concretely, the first phase difference and the second phase differences of the plural speakers 10 are stored in the memory for each frequency. Then, the active vibration noise control device 50 can select one or more speakers 10 by using the stored first phase difference and the stored second phase differences.

For example, a phase difference between the first phase difference and the second phase difference, by which the vibration noise does not increase at the pseudo evaluation point 31 when the active vibration noise control device 50 performs the process for decreasing the vibration noise, can be used as the above predetermined value. As an example, 60 degrees can be used as the predetermined value.

Next, a description will be given of an example of a relationship between the phase difference between the first and second differences and a reduction effect of the vibration noise at the pseudo evaluation point 31, with reference to FIGS. 5A to 5D. Here, such an example that the amplitude of the noise signal is approximately the same as that of the control signal is shown.

Figures 5A, 5B, 5C, 5D:
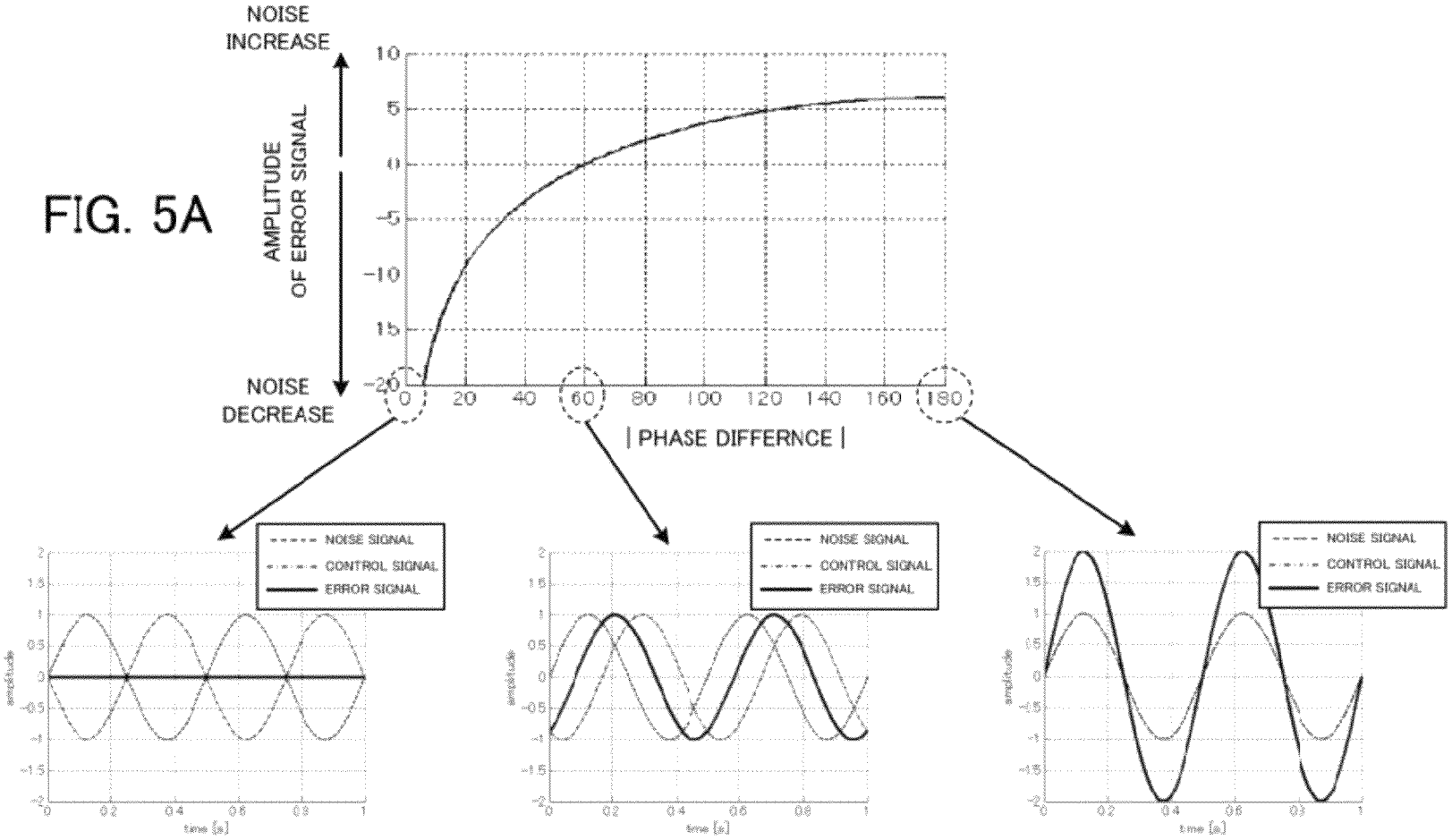
FIGS. 5A to 5D show examples of a relationship between a phase difference between first and second differences and a reduction effect of a vibration noise at a pseudo evaluation point.

In FIG. 5A, a vertical axis shows the phase difference (absolute value) between the first phase difference and the second phase difference, and a vertical axis shows the amplitude of the error signal at the pseudo evaluation point 31. The error signal at the pseudo evaluation point 31 is obtained by a predetermined operational expression. Additionally, in FIG. 5A, the vertical axis shows that the vibration noise decreases when the value becomes smaller than "0", and that the vibration noise increases when the value becomes larger than "0". In the specification, decreasing the vibration noise is referred to as "noise-canceling".

FIGS. 5B, 5C and 5D show relationships between a noise signal (shown by a broken line), a control signal (shown by a dashed-dotted line) and an error signal (shown by a solid line). Additionally, FIGS. 5B, 5C and 5D show the relationships when the phase difference (absolute value) between the first and second phase differences is 0 degrees, 60 degrees and 180 degrees, respectively. According to FIGS. 5B, 5C and 5D, it can be understood that the error signal is approximately "0" when the phase difference is 0 degrees, and that the phase difference neither increase nor decreases when the phase difference is 60 degrees, and that the error signal increases when the phase difference is 180 degrees.

According to FIGS. 5A to 5D, it can be said that the vibration noise at the pseudo evaluation point 31 decreases much more as the phase difference (absolute value) between the first and second phase differences becomes smaller. Additionally, when the phase difference (absolute value) between the first and second phase differences is smaller than 60 degrees, it can be said that the vibration noise at the pseudo evaluation point 31 does not at least increase. Therefore, it is preferable to use 60 degrees as the predetermined value used for the determination of the phase difference between the first and second phase differences, when the speakers 10 to be operated are selected.

By the above embodiment, it becomes possible to stably decrease the vibration noise at the pseudo evaluation point 31 independently of the frequency band of the vibration noise. Additionally, since the selection of the speakers 10 by the active vibration noise control device 50 is equivalent to the phase process by using the filter coefficient F in the comparative example, the embodiment can appropriately reduce a processing load compared with the comparative example.

The above selection of the speakers 10 is performed by a controlling unit (which is not shown in FIG. 2) in the active vibration noise control device 50. Namely, the controlling unit selects one or more speakers 10 from the plural speakers 10 based on the relationship between the first phase difference and the second phase differences of the plural speakers 10, and makes only the selected one or more speakers 10 output the control sounds. As an example, the controlling unit operates the speakers 10 which are selected, by switching the said speakers 10 on. Meanwhile, the controlling unit stops the speakers 10 which are not selected, by switching the said speakers 10 off. In this case, the adaptive notch filter 15, the reference signal generating unit 16 and the w-updating unit 17 which perform the process for calculating the control signals of the speakers 10 which are not selected may be continued to operate, or may be stopped.

First Embodiment

Figure 6:
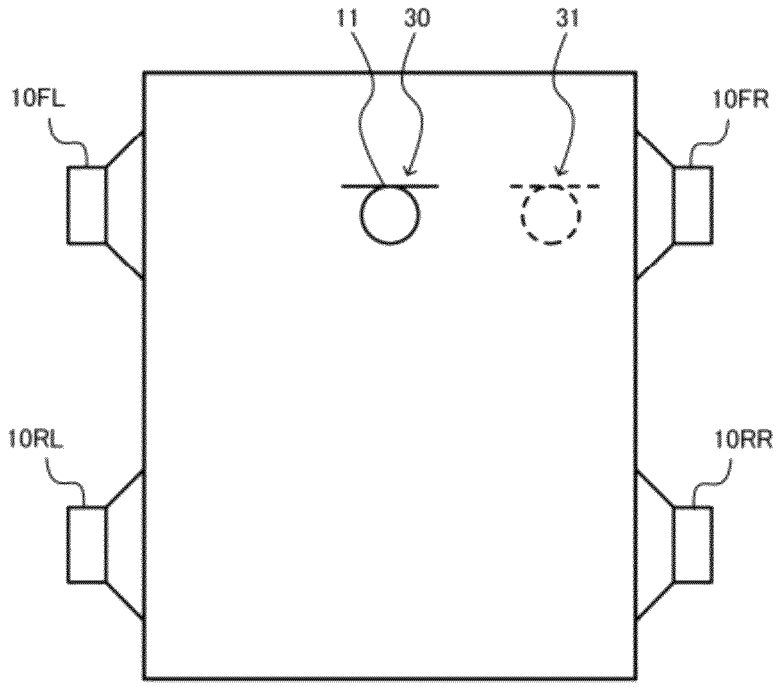
FIG. 6 shows an installation example of speakers and a microphone in a first embodiment.

Next, a description will be given of a first embodiment. In the first embodiment, it is assumed that the active vibration noise control device 50 includes four speakers 10FL, 10FR, 10RL and 10RR and a microphone 11 which are installed as shown in FIG. 6. The active vibration noise control device 50 in the first embodiment has the basic configuration as shown in FIG. 2, and performs the process for decreasing the vibration noise at the evaluation point 30, too. For example, the active vibration noise control device 50 is mounted on the vehicle.

Hereinafter, the second phase difference of the speaker 10FL is expressed as "P_FL", and the second phase difference of the speaker 10FR is expressed as "P_FR", and the second phase difference of the speaker 10RL is expressed as "P_RL", and the second phase difference of the speaker 10RR is expressed as "P_RR". In addition, the first phase difference is expressed as "P_n". When the speakers 10FL, 10FR, 10RL and 10RR are used without distinction, these are simply expressed as "speaker 10".

In the first embodiment, two speakers 10 are selected from the four speakers 10 so that the vibration noise stably decreases at the pseudo evaluation point 31 as shown in FIG. 6. Namely, a pair of speakers 10 is selected. Concretely, in consideration of the results shown in FIGS. 5A to 5D, the active vibration noise control device 50 in the first embodiment selects two speakers 10 having such a second phase difference that the absolute value of the difference from the first phase difference is equal to or smaller than 60 degrees, from the four speakers 10, and makes only the selected two speakers 10 output the control sounds. In this case, when there are more than two speakers 10 having such a second phase difference that the absolute value of the difference from the first phase difference is equal to or smaller than 60 degrees, the active vibration noise control device 50 preferentially selects the speaker 10 having such a second phase difference that the absolute value of the difference from the first phase difference is small. Specifically, the active vibration noise control device 50 can select a speaker 10 having such a second phase difference that the absolute value of the difference from the first phase difference is smallest, and a speaker 10 having such a second phase difference that the absolute value of the difference from the first phase difference is second smallest.

Figures 7A, 7B:
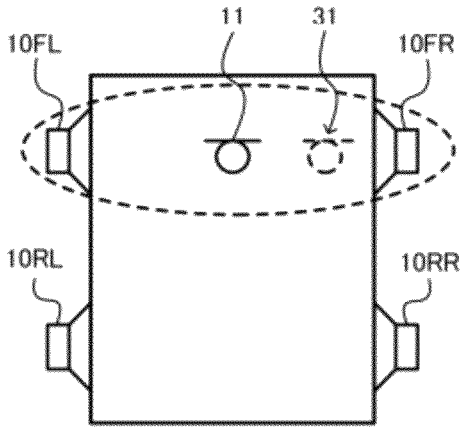
FIGS. 7A and 7B show diagrams for explaining a method for selecting speakers in a first embodiment.

Next, a description will be given of an example of a method for selecting the speakers 10 in the first embodiment, with reference to FIGS. 7A and 7B. Here, FIG. 7A shows such an example that the first phase difference P_n of the vibration noise is "−40 degrees", and the second phase difference P_FL of the speaker 10FL is "0 degrees", and the second phase difference P_FR of the speaker 10FR is "−50 degrees", and the second phase difference P_RL of the speaker 10RL is "30 degrees", and the second phase difference P_RR of the speaker 10RR is "25 degrees".

In this example, the speakers 10FL and 10FR are the speakers having such a second phase difference that the absolute value of the difference from the first phase difference P_n is equal to or smaller than 60 degrees. Therefore, as shown by a dashed area in FIG. 7B, the speakers 10FL and 10FR are selected as a pair of speakers 10 which output the control sounds.

Figure 8A:
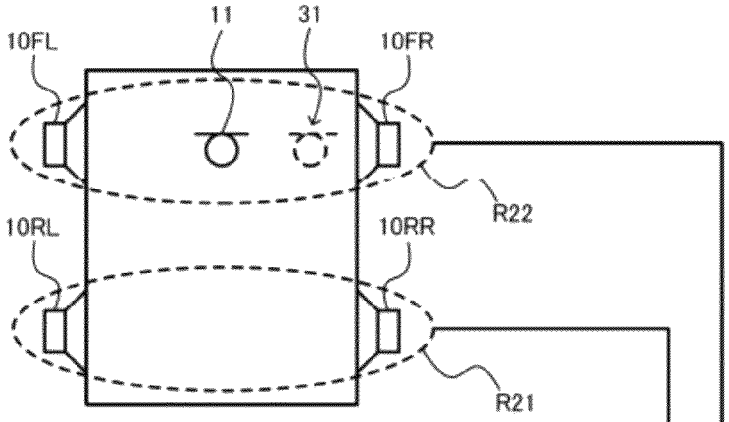
FIGS. 8A to 8C show examples of a reduction effect of a vibration noise at a pseudo evaluation point, by a first embodiment.
Figure 8B:
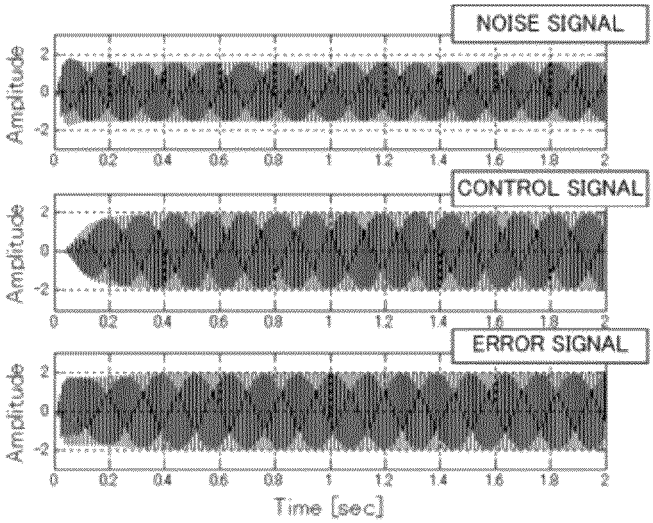
Figure 8C:
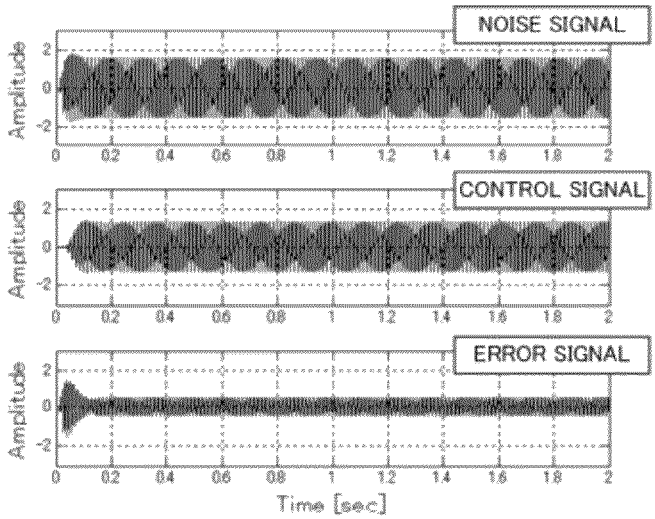

Next, a result in case of using the speakers 10FL and 10FR which are selected as mentioned above is compared with a result in case of using the speakers 10RL and 10RR which are not selected, with reference to FIGS. 8A to 8C. Here, the results in case of using a sine wave of 75 [Hz] as the noise signal are shown.

FIG. 8A shows the same diagram as FIG. 6. FIGS. 8B and 8C show examples of a reduction effect of the vibration noise at the pseudo evaluation point 31 in case of using the active vibration noise control device 50 in the first embodiment, respectively. Concretely, FIG. 8B shows a result example in case of making only the speakers 10RL and 10RR (see a dashed area R21 in FIG. 8A) output the control sounds, and FIG. 8C shows a result example in case of making only the speakers 10FL and 10FR (see a dashed area R22 in FIG. 8A) output the control sounds. Additionally, FIGS. 8B and 8C show time changes of a noise signal, a control signal and an error signal, in descending order.

According to FIG. 8B, it can be understood that the error signal increases when the speakers 10RL and 10RR output the control sounds. Namely, it can be said that the vibration noise increases. Meanwhile, according to FIG. 8C, it can be understood the error signal decreases when the speakers 10FL and 10FR output the control sounds. Namely, it can be said that the vibration noise appropriately decreases. Therefore, by making the speakers 10 selected by the above method output the control sounds, it can be understood that the vibration noise can stably decrease at the pseudo evaluation point 31.

Second Embodiment

Next, a description will be given of a second embodiment. In the second embodiment, the amplitude of the control signals used by the above selected plural speakers 10 is controlled. Concretely, in the second embodiment, so that the second phase difference of a control sound (hereinafter referred to as "combined control sound") obtained by combining the control sounds of the selected plural speakers 10 approaches the first phase difference of the vibration noise (in other words, so that the second phase difference of the combined control sound approximates the first phase difference), an amplitude balance of the control signals of the plural speakers 10 is changed. The second phase difference of the combined control sound corresponds to a difference between phase characteristics of the combined control sound to the evaluation point 30 and phase characteristics of the combined control sound to the pseudo evaluation point 31, when the plural speakers 10 output the control sounds at the same time.

As an example, by performing a weighting process when the filter coefficient is updated, the amplitude of the control signals used by the plural speakers 10 can be controlled. Concretely, the weighting process is performed for the step-size parameter μ used when the filter coefficient of the adaptive notch filter is updated for each of the plural speakers 10. In this case, a coefficient (hereinafter referred to as "weight coefficient s") for weighting the step-size parameter μ is used, and the value of the step-size parameter μ is changed by setting the weight coefficient s to various values so as to control the amplitude of the control signal for each of the plural speakers 10.

However, it is preferable that the filter coefficient is updated based on a leaky LMS algorithm in order to appropriately control the amplitude by weighting the step-size parameter μ. Concretely, it is preferable that a leak coefficient (corresponding to a coefficient λ for suppressing a growth of "w") is included in the w-updating units 17*a* and 17*b*.

Additionally, it is preferable that the weight coefficient is equal to or smaller than 1 in order to stably operate the active vibration noise control device.

Next, a description will be given of an example of the active vibration noise control device in the second embodiment, with reference to FIG. 9.

Figure 9:
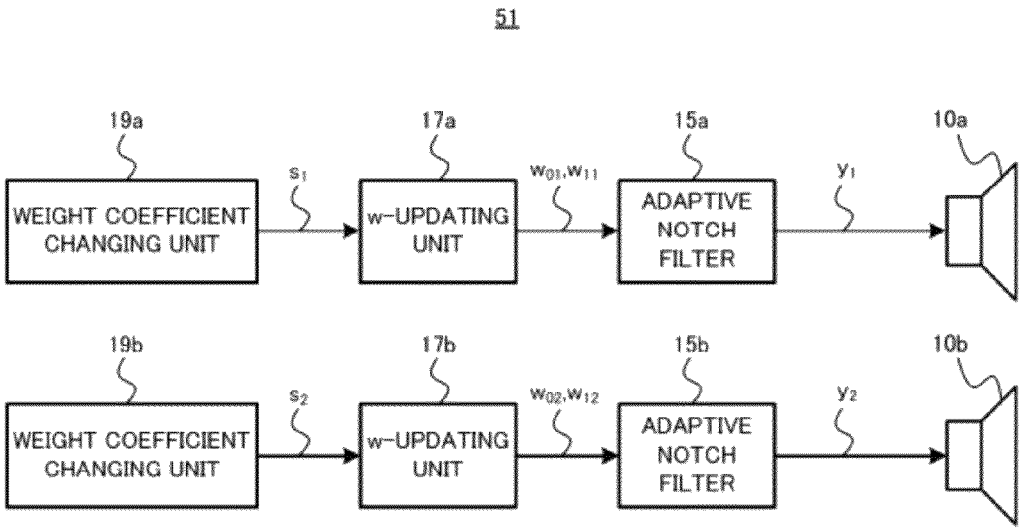
FIG. 9 is a block diagram showing a configuration of an active vibration noise control device in a second embodiment.

FIG. 9 is a block diagram showing a schematic configuration of the active vibration noise control device 51 in the second embodiment. FIG. 9 shows only a part of the components included in the active vibration noise control device 51 in the second embodiment. The components which are not shown in FIG. 9 are the same as those of the above active vibration noise control device 50 (see FIG. 2). Hereinafter, the same reference numerals are given to the same components and signals as those of the active vibration noise control device 50, and explanations thereof are omitted. In addition, the components and signals which are not especially explained are the same as those of the active vibration noise control device 50.

The active vibration noise control device 51 in the second embodiment is different form the active vibration noise control device 50 in that weight coefficient changing units 19*a* and 19*b* are included. Though only two speakers 10*a* and 10*b* are shown in FIG. 9 as a matter of convenience, the active vibration noise control device 51 actually includes more than two speakers 10.

The weight coefficient changing units 19*a* and 19*b* set weight coefficients $s_1$ and $s_2$ for weighting the step-size parameters μ used by the w-updating units 17*a* and 17*b*, respectively. Concretely, so that the second phase difference of the combined control sound obtained by combining the control sounds of the speakers 10*a* and 10*b* approximates the first phase difference of the vibration noise, the weight coefficient changing units 19*a* and 19*b* set the weight coefficients $s_1$ and $s_2$ so as to control the amplitude of the control signals $y_1$ and $y_2$. In this case, the weight coefficient changing units 19*a* and 19*b* set the weight coefficients $s_1$ and $s_2$ in accordance with the difference between the first phase difference and the second phase differences of each of the speakers 10*a* and 10*b*. Specifically, the weight coefficient changing units 19*a* and 19*b* set the weight coefficients $s_1$ and $s_2$ in accordance with a ratio between (1) a difference between the first phase difference and the second difference of the speaker 10*a* and (2) a difference between the first phase difference and the second difference of the speaker 10*b*. In this case, the weight coefficient s used by one of the speakers 10 which has the second phase difference close to the first phase difference is set to a larger value than the weight coefficient s used by the other. Thus, the weight coefficient changing units 19*a* and 19*b* correspond to an example of the amplitude controlling unit.

It is not limited that the weight coefficient changing units 19*a* and 19*b* calculate the weight coefficients $s_1$ and $s_2$ during the operation of the active vibration noise control device 51. The weight coefficient changing units 19*a* and 19*b* can use the weight coefficients $s_1$ and $s_2$ preliminarily calculated by a measurement and/or a predetermined operational expression.

The w-updating units 17*a* and 17*b* updated the filter coefficients based on the step-size parameters μ (hereinafter referred to as "$\mu_1$'" and "$\mu_2$'") which are weighted by the weight coefficients $s_1$ and $s_2$ set by the weight coefficient changing units 19*a* and 19*b*. In this case, the step-size parameter $\mu_1$' is expressed by "$\mu_1'=\mu_1*s_1$", and the step-size parameter $\mu_2$' is expressed by "$\mu_2'=\mu_2*s_2$". The w-updating units 17*a* and 17*b* substitute the step-size parameters $\mu_1$' and $\mu_2$' into the step-size parameters $\mu_1$ and $\mu_2$ in the above equations (5) to (8), so as to calculate the filter coefficients $w_{01}$, $w_{11}$, $w_{02}$ and $w_{12}$. Then, the adaptive notch filters 15*a* and 15*b* generate the control signals $y_1$ and $y_2$ used by the speakers 10*a* and 10*b* based on the filter coefficients $w_{01}$, $w_{11}$, $w_{02}$ and $w_{12}$ updated by the w-updating units 17*a* and 17*b*.

Additionally, when the filter coefficients are updated based on the leaky LMZ algorism in addition to the above weighting process, the above equation (5) for calculating the updated filter coefficient $w_{01}(n+1)$ is transformed into an equation (9), for example.

$$w_{01}(n+1)=(1-\lambda_{01})\cdot w_{01}(n)-\mu_1'\cdot e(n)\cdot r_{01}(n) \tag{9}$$

The transformation as shown in the equation (9) is similarly applied to the equations (6) to (8) for calculating $w_{11}(n+1)$, $w_{02}(n+1)$ and $w_{12}(n+1)$.

Figure 10A:
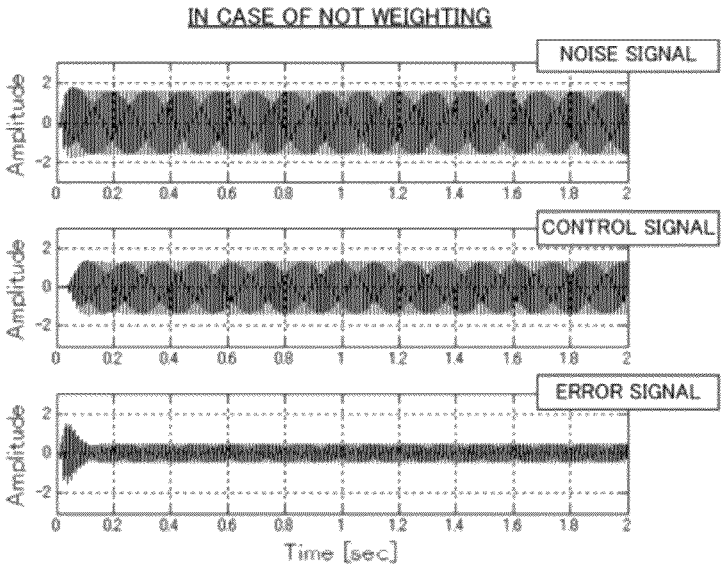
FIGS. 10A and 10B show examples of a reduction effect of a vibration noise at a pseudo evaluation point, by a second embodiment.
Figure 10B:
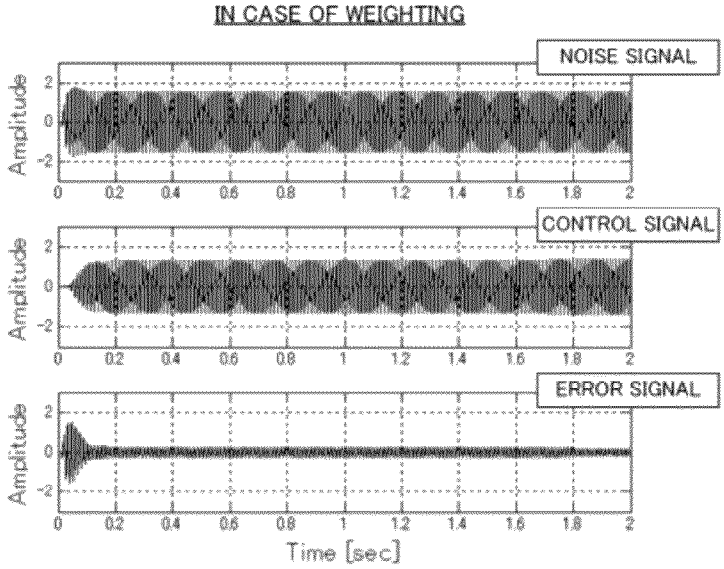

Next, a reduction effect of the vibration noise at the pseudo evaluation point 31 in case of performing the above weighting process is compared with a reduction effect of the vibration noise at the pseudo evaluation point 31 in case of not performing the above weighting process, with reference to FIGS. 10A and 10B. Here, it is assumed that the active vibration noise control device 51 includes the four speakers 10FL, 10FR, 10RL and 10RR and the microphone 11 which are installed as shown in FIG. 6, and that the active vibration noise control device 51 aims to decrease the vibration noise at the pseudo evaluation point 31 shown in FIG. 6. Additionally, it is assumed that the first and second phase differences have the values as shown in FIG. 7A, and that the speakers 10FL and 10FR are selected as a pair of speakers 10 which output the control sounds.

The weight coefficient $s_1$ is used for the speaker 10FL, and the weight coefficient $s_2$ is used for the speaker 10FR. In this case, since an absolute value of a difference between the first phase difference P_n (=−40 degrees) and the second phase difference P_FL (=0 degrees) is 40 degrees and an absolute value of a difference between the first phase difference P_n (=−40 degrees) and the second phase difference P_FR (=−50 degrees) is 10 degrees, a ratio of the these absolute values is "40:10". Therefore, "0.25:1" corresponding to "10:40" being an inverse ratio of the above ratio is set as the weight coefficients $s_1$ and $s_2$ ("$s_1$:$s_2$=0.25:1"). When the above weight coefficients $s_1$ and $s_2$ are used, the second phase difference of the combined control sound of the selected speakers 10FL and 10FR becomes "−40 degrees". So, the second phase difference of the combined control sound coincides with the first phase difference P_n. Meanwhile, when the above weighting process is not performed (in other words, when the weight coefficients $s_1$ and $s_2$ are set to 1), the second phase difference of the combined control sound of the speakers 10FL and 10FR becomes "−25 degrees".

FIG. 10A shows an example of a reduction effect of the vibration noise at the pseudo evaluation point 31 in case of not performing the weighting process when the filter coefficient is updated. FIG. 10B shows an example of a reduction effect of the vibration noise at the pseudo evaluation point 31 in case of performing the weighting process when the filter coefficient is updated. Concretely, FIGS. 10A and 10B show time changes of a noise signal, a control signal and an error signal, in descending order. Here, the results in case of using a sine wave of 75 [Hz] as the noise signal are shown. FIG. 10A shows the same result as FIG. 8C.

By comparing FIG. 10B with FIG. 10A, it can be understood that the error signal in case of performing the weighting process is smaller than the error signal in case of not performing the weighting. Namely, it can be said that the vibration noise decreases much more. Concretely, the reduction effect in case of not performing the weighting process is "−10 [dB]", and the reduction effect in case of performing the weighting process is "−16 [dB]". According to the above result, by the second embodiment, it can be understood that the vibration noise at the pseudo evaluation point 31 can decrease more effectively.

Figure 11A:
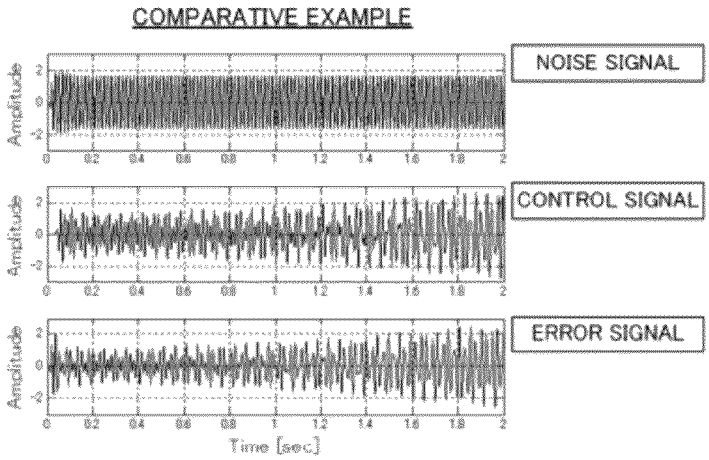
FIGS. 11A and 11B shows result examples by a comparative example and a second embodiment.
Figure 11B:
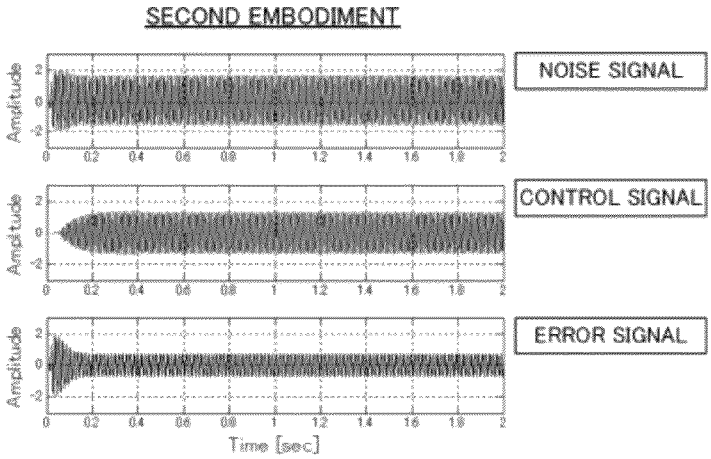

Next, a result by the second embodiment is compared with a result by the above comparative example, with reference to FIGS. 11A and 11B.

FIG. 11A shows an example of a reduction effect of the vibration noise at the pseudo evaluation point 31 by the comparative example. FIG. 11B shows an example of a reduction effect of the vibration noise at the pseudo evaluation point 31 by the second embodiment. Concretely, FIGS. 11A and 11B show time changes of a noise signal, a control signal and an error signal, in descending order. Here, the results in case of using a sine wave of 61 [Hz] as the noise signal are shown. The frequency corresponds to such a frequency that the filter coefficient F in the comparative example becomes unstable (see FIGS. 3A to 3C). Additionally, as the result by the second embodiment, FIG. 11B shows such a result that two speakers 10 are selected by the above method, and that the amplitude of the control signals of the selected two speakers 10 is controlled by the weight coefficients $s_1$ and $s_2$. In this case, "1" is used as the weight coefficient $s_1$, and "0.1" is used as the weight coefficient $s_2$ ("$s_1$:$s_2$=1:0.1").

By comparing FIG. 11B with FIG. 11A, it can be understood the second embodiment can stably decrease the vibration noise at the pseudo evaluation point 31 compared with the comparative example.

The above embodiment shows such an example that the weight coefficient s for weighting the step-size parameter μ is set in accordance with the difference between the first phase difference and the second phase difference of each of the plural speakers 10. As another example, the weight coefficient s can be preliminarily calculated by a measurement and/or a predetermined operational expression, and can be stored in a memory so as to use the stored weight coefficient s. For example, for each of two speakers selected based on the first phase difference of the frequency to be controlled, such a weight coefficient s that an appropriate gain is obtained can be preliminarily stored.

Though the above embodiment shows such a example that the weighting process is performed when the filter coefficient is updated, it is not limited to use the said method for controlling the amplitude of the control signal used by each of the plural speakers 10. As another example, a weighting process can be performed for an output gain of each of the plural speakers 10, so as to control the amplitude of the control signal of each of the plural speakers 10. In other words, the weighting process can be directly performed for the control signals used by each of the plural speakers 10. The said example can use a similar weight coefficient s to that of the above embodiment, too.

[Modification]

Hereinafter, a description will be given of a modification of the above embodiments.

Though the above first and second embodiments show such an example that two speakers are selected, more than two speakers may be selected. When more than two speakers are selected, a similar method to the method for selecting two speakers can be used, too. Additionally, when more than two speakers are selected, the amplitude of the control signals used by each of the selected speakers can be controlled by a similar method to that of the second embodiment, too.

The above first embodiment indicates that the speakers having such a second phase difference that the absolute value of the difference from the first phase difference is equal to or smaller than the predetermined value is selected from the plural speakers. When more than two speakers are selected from the plural speakers, it is not necessary that all of the selected speakers satisfy such a condition (hereinafter referred to as "first condition") that the absolute value of the difference between the first phase difference and the second phase difference is equal to or smaller than the predetermined value. Namely, if at least one speaker in the selected speakers satisfies the first condition, it is not necessary that other speakers satisfy the first condition. This is because there is a high possibility that the increase in vibration noise does not occur at the pseudo evaluation point 31 if at least one speaker satisfies the first condition.

It is not limited to select the speakers by using the first condition. As another example, when two speakers are selected from the plural speakers, instead of the first condition, such a condition (hereinafter referred to as "second condition") that both a speaker having the second phase difference being larger than the first phase difference and a speaker having the second phase difference being smaller than the first phase difference are selected can be used. Namely, in the example, such a pair of speakers that the first phase difference exists between the second phase differences of the two speakers can be selected from the plural speakers. This is because, when the two speakers satisfying the second condition are selected, there is a high possibility that the absolute value of the difference between the first phase difference and the second phase difference of the combined control sound of the two speakers becomes equal to or smaller than the predetermined value (60 degrees) used in the first condition. Namely, there is a high possibility that the increase in vibration noise does not occur at the pseudo evaluation point 31. For example, the selection by using the second condition can be performed when there is not a speaker satisfying the first condition. Meanwhile, when there is more than one pair of speakers satisfying the second condition, a pair of speakers having such a second phase difference that the absolute value of the difference from the first phase difference is small can be preferentially selected.

It is not limited to select the speakers by using the second condition instead of the first condition. The speakers can be selected by using both the first condition and the second condition. Namely, a pair of speakers satisfying both the first condition and the second condition can be selected from the plural speakers. For example, when there are plural speakers satisfying the first condition, a pair of speakers satisfying the second condition can be selected from the plural pairs of speakers satisfying the first condition.

It is not limited to select more than one speaker from the plural speakers. Only one speaker may be selected from the plural speakers. In this case, one speaker can be selected from the plural speakers, by using the first condition. When there are plural speakers satisfying the first condition, a speaker having such a second phase difference that the absolute value of the difference from the first phase difference is smallest can be selected.

Though the above embodiments show such an example that 60 degrees is used as the predetermined value of the first condition, it is not limited to use 60 degrees as the predetermined value. While the above embodiments use 60 degrees as the predetermined value from the view point of the suppression of the increase in the vibration noise at the pseudo evaluation point 31, the predetermined value can be set to various values in accordance with a level of the decrease in the vibration noise at the pseudo evaluation point 31, for example.

It is not limited to select the same speakers in all of the frequency bands of the vibration noise. As another example, the selected speakers can be changed in accordance with the frequency band of the vibration noise. This is because the first phase difference and the second phase differences of the plural speakers tend to change depending on the frequency band of the vibration noise. For example, a table associated with the phase difference for each frequency band or a table associated with the speakers to be selected for each frequency band can be prepared, and the selected speakers can be changed in accordance with the frequency band by using the said table.

It is not limited that the present invention is applied to the active vibration noise control device having two or four speakers. Additionally, it is not limited that the present invention is applied to the active vibration noise control device having only one microphone. The present invention can be applied to an active vibration noise control device having three speakers or more than four speakers, and can be applied to an active vibration noise control device having more than one microphone.

It is not limited that the present invention is applied to the vehicle. Other than the vehicle, the present invention can be applied to various kinds of transportation such as a ship or a helicopter or an airplane.

INDUSTRIAL APPLICABILITY

This invention is applied to closed spaces such as an interior of transportation having a vibration noise source (for example, engine), and can be used for actively controlling a vibration noise.

DESCRIPTION OF REFERENCE NUMBERS

10*a*, 10*b* Speaker
11 Microphone
13 Frequency Detecting Unit

14*a* Cosine Wave Generating Unit
14*b* Sine Wave Generating Unit
15*a*, 15*b* Adaptive Notch Filter
16*a*, 16*b* Reference Signal Generating Unit
17*a*, 17*b* w-Updating Unit
19*a*, 19*b* Weight Coefficient Changing Unit
20 Controller
30 Evaluation Point
31 Pseudo Evaluation Point
50, 51 Active Vibration Noise Control Device

The invention claimed is:

1. An active vibration noise control device for canceling a vibration noise from a vibration noise source by making plural speakers output control sounds, comprising:

a microphone, the microphone positioned to detect the vibration noise generated from the vibration noise source; and a controller which selects at least one speaker from the plural speakers and makes the selected speaker output the control sound, thereby to reduce the vibration noise at an evaluation point, wherein the controller calculates i) a first phase difference which corresponds to a difference between phase characteristics of the vibration noise from the vibration noise source to the evaluation point corresponding to an installation position of the microphone and phase characteristics of the vibration noise from the vibration noise source to a pseudo evaluation point corresponding to a different position from the installation position, ii) a second phase difference for each of the plural speakers which corresponds to a difference between phase characteristics of the control sound from the speaker to the evaluation point and phase characteristics of the control sound from the speaker to the pseudo evaluation point, and selects at least one speaker having such a second phase difference that an absolute value of a difference from the first phase difference is equal to or smaller than a predetermined value.

2. The active vibration noise control device according to claim 1, wherein the microphone functions as an error signal output unit which outputs an error signal based on a cancellation error between the vibration noise and the control sounds detected by the microphone, and wherein the controller comprises:

a basic signal generating unit which generates a basic signal based on a frequency of the vibration noise generated by a vibration noise source;

an adaptive notch filter which generates control signals provided to each of the plural speakers by applying a filter coefficient to the basic signal, in order to make the plural speakers output the control sounds so that the vibration noise generated by the vibration noise source is cancelled;

a reference signal generating unit which generates a reference signal from the basic signal based on transfer functions from the plural speakers to the microphone; and a filter coefficient updating unit which updates the filter coefficient used by the adaptive notch filter based on the error signal and the reference signal so as to minimize the error signal, wherein the first phase difference and the second phase difference are preliminarily calculated by a measurement and/or a predetermined operational expression, and are stored in a storage unit.

3. The active vibration noise control device according to claim 1, wherein the controller selects at least one speaker having the second phase difference being larger than the first phase difference, and at least one speaker having the second phase difference being smaller than the first phase difference, from the plural speakers.

4. The active vibration noise control device according to claim 2, wherein the controller selects at least one speaker having the second phase difference closest to the first phase difference, from the plural speakers.

5. The active vibration noise control device according to claim 1, wherein the controller changes the speaker to be selected, in accordance with a frequency band of the vibration noise.

6. The active vibration noise control device according to claim 1, wherein the controller further comprises an amplitude controlling unit which controls an amplitude of the control signal of the selected speaker, based on the first phase difference and the second phase difference of the selected speaker.

7. The active vibration noise control device according to claim 6, wherein, so that the second phase difference of a control sound obtained by combining control sounds of plural selected speakers approaches the first phase difference, the amplitude controlling unit controls the amplitude of the control signals of each of the said plural speakers.

8. The active vibration noise control device according to claim 3, wherein the controller selects at least one speaker having the second phase difference closest to the first phase difference, from the plural speakers.

9. An active vibration noise control device, comprising:

a plurality of speakers including first and second speakers;

a microphone positioned at an installation position, the installation position being a evaluation point at which the microphone detects a vibration noise generated from a vibration noise source;

a controller with i) an input connected to the microphone to receive detected vibration noise from the microphone, and ii) outputs connected to each of the first and second speakers to respectively output first and second control signals $y_1(n)$ and $y_2(n)$, based on the detected vibration noise, to the first and second speakers so that the first and second speakers further respectively output control sounds corresponding to the first and second control signals $y_1(n)$ and $y_2(n)$ and the microphone further detects the control sounds output by the first and second speakers, wherein i) a first phase difference corresponding to a difference between phase characteristics of the vibration noise from the vibration noise source to the evaluation point and phase characteristics of the vibration noise from the vibration noise source to a pseudo evaluation point corresponding to a different position from the installation position is calculated, ii) a second phase difference for each of the first and second plural speakers which corresponds to a difference between phase characteristics of the control sound from the speaker to the evaluation point and phase characteristics of the control sound from the speaker to the pseudo evaluation point is calculated, and iii) at least one of the first and second speakers having the second phase difference is selected such that an absolute value of a difference from the first phase difference is equal to or smaller than a predetermined value to make the selected at least one of the first and second speakers output the control sound to thereby reduce the vibration noise both at the evaluation point and at the pseudo evaluation point.

10. The active vibration noise control device according to claim 9, wherein, the controller comprises:

a frequency detecting unit connected to a supply of the vibration noise and that detects a frequency ω0 of the vibration noise, a cosine wave generating unit connected to an output of the frequency detecting unit and that generates a basic cosine wave x0(n) which includes the detected frequency ω0 from the frequency detecting unit, a sine wave generating unit connected to the output of the frequency detecting unit and that generates a sine wave x1(n) which includes the detected frequency ω0 from the frequency detecting unit, a first reference signal generating unit connected to an output of the cosine wave generating unit and to an output of the sine wave generating unit, a second reference signal generating unit connected to the output of the cosine wave generating unit and to the output of the sine wave generating unit, a first w-updating unit connected i) to an output of the microphone to receive an error signal e(n) from the microphone and ii) to an output of the first reference signal generating unit, a second w-updating unit connected i) to the output of the microphone to receive the error signal e(n) from the microphone and ii) to an output of the second reference signal generating unit, a first adaptive notch filter connected to the output of the cosine wave generating unit, to the output of the sine wave generating unit, and to an output of first w-updating unit, the first adaptive notch filter having an output connected to the first speaker, the first adaptive notch filter i) receiving first filter coefficients $w_{01}(n)$ and $w_{11}(n)$ from the first w-updating unit, and ii) based on the first filter coefficients $w_{01}(n)$ and $w_{11}(n)$, performing a first filter process of the basic cosine wave $x_0(n)$ and the basic sine wave $x_0(n)$, the thus first filtered basic cosine wave $x_0(n)$ and the basic sine wave $x_0(n)$ being combined to thereby provide the first control signal $y_1(n)$ to the first speaker, and a second adaptive notch filter connected to the output of the cosine wave generating unit, to the output of the sine wave generating unit, and to an output of second w-updating unit, the second adaptive notch filter having an output connected to the second speaker, the second adaptive notch filter i) receiving second filter coefficients $w_{02}(n)$ and $w_{12}(n)$ from the second w-updating unit, and ii) based on the second filter coefficients $w_{02}(n)$ and $w_{12}(n)$, performing a second filter process of the basic cosine wave $x_0(n)$ and the basic sine wave $x_0(n)$, the thus second filtered basic cosine wave $x_0$ (n) and the basic sine wave $x_0$ (n) being combined to thereby provide a second control signal $y_2(n)$ to the second speaker, and the first and second speakers generate the respective control sounds corresponding to the first control signal $y_1(n)$ and the second control signal $y_2(n)$ generated by the first and second adaptive notch filters, respectively, which generated respective control sounds are transferred to the microphone, whereupon the microphone detecting a cancellation error between the vibration noise and the control sounds, generates the error signal e(n) received by the first and second w-updating units.

11. The active vibration noise control device according to claim 10, wherein, the basic cosine wave x0(n) satisfies the equation $x_0(n)=A\cos(\omega_0 n+\phi)$, where "A" indicates amplitude, and "ϕ" indicates an initial phase, the basic sine wave x0(n) satisfies the equation $x_0(n)=A\sin(\omega_0 n+\phi)$, where the "A" indicates the amplitude, and the "ϕ" indicates the initial phase, the first adaptive notch filter adds a value obtained by multiplying the basic cosine wave $x_0(n)$ by the first filter coefficient $w_{01}(n)$ to a value by multiplying the basic sine wave $x_1(n)$ by the first filter coefficient $w_{11}(n)$, so as to calculate the control signal $y_1(n)$, and the second adaptive notch filter adds a value obtained by multiplying the basic cosine wave $x_0(n)$ by the second filter coefficient $w_{02}(n)$ to a value by multiplying the basic sine wave $x_1(n)$ by the second filter coefficient $w_{12}(n)$ so as to calculate the control signal $y_2(n)$, where the following equations are satisfied:

$$y_1(n)=w_{01}(n)x_0(n)+w_{11}(n)x_1(n)$$

$$y_2(n)=w_{02}(n)x_0(n)+w_{12}(n)x_1(n).$$

12. The active vibration noise control device according to claim 10, wherein, the first and second adaptive notch filters respectively generate the first control signal $y_1(n)$ to the first speaker and the second control signal $y_2(n)$ to the second speaker in order to make the first and second speakers output the control sounds so that the vibration noise generated by the vibration noise source is cancelled, and the first and second w-updating units update the filter coefficients used by the first and second adaptive notch filters based on the error signal so as to minimize the error signal e(n), and wherein the first phase difference and the second phase difference are preliminarily calculated by a measurement and/or a predetermined operational expression, and are stored in a storage unit.

13. The active vibration noise control device according to claim 9, wherein, one of the first and second speakers having the second phase difference being larger than the first phase difference is selected, and another of the first and second speakers having the second phase difference being smaller than the first phase difference is selected.

14. The active vibration noise control device according to claim 10, wherein, from the first and second speakers, one of the first and second speakers having the second phase difference closest to the first phase difference is selected.

15. The active vibration noise control device according to claim 9, further comprising an amplitude controller which controls an amplitude of the control signal of the selected speaker, based on the first phase difference and the second phase difference of the selected speaker selected.

16. An active vibration noise control device, comprising:

first and second speakers;

a microphone positioned at an installation position, the installation position being a evaluation point at which the microphone detects a vibration noise generated from a vibration noise source; and a controller which comprises:

a frequency detecting unit connected to a supply of the vibration noise and that detects a frequency ω0 of the vibration noise, a cosine wave generating unit connected to an output of the frequency detecting unit and that generates a basic cosine wave x0(n) which includes the detected frequency ω0 from the frequency detecting unit, a sine wave generating unit connected to the output of the frequency detecting unit and that generates a sine wave x1(n) which includes the detected frequency ω0 from the frequency detecting unit, a first reference signal generating unit connected to an output of the cosine wave generating unit and to an output of the sine wave generating unit, a second reference signal generating unit connected to the output of the cosine wave generating unit and to the output of the sine wave generating unit, a first w-updating unit connected i) to an output of the microphone to receive an error signal e(n) from the microphone and ii) to an output of the first reference signal generating unit and to the microphone, a second w-updating unit connected i) to the output of the microphone to receive the error signal e(n) from the microphone and ii) to an output of the second reference signal generating unit, a first adaptive notch filter connected to the output of the cosine wave generating unit, to the output of the sine wave generating unit, and to an output of first w-updating unit, the first adaptive notch filter having an output connected to the first speaker, the first adaptive notch filter i) receiving first filter coefficients w01(n) and w11(n) from the first w-updating unit, and ii) based on the first filter coefficients w01(n) and w11(n), performing a first filter process of the basic cosine wave x0(n) and the basic sine wave x0(n), the thus first filtered basic cosine wave x0(n) and the basic sine wave x0(n) being combined to thereby provide the first control signal y1(n) to the first speaker, and a second adaptive notch filter connected to the output of the cosine wave generating unit, to the output of the sine wave generating unit, and to an output of second w-updating unit, the second adaptive notch filter having an output connected to the second speaker, the second adaptive notch filter i) receiving second filter coefficients w02(n) and w12(n) from the second w-updating unit, and ii) based on the second filter coefficients w02(n) and w12(n), performing a second filter process of the basic cosine wave x0(n) and the basic sine wave x0(n), the thus second filtered basic cosine wave x0(n) and the basic sine wave x0(n) being combined to thereby provide a second control signal y2(n) to the second speaker, and the first and second speakers generate respective control sounds corresponding to the first control signal y1(n) and the second control signal y2(n) generated by the first and second adaptive notch filters, respectively, which generated respective control sounds are transferred to the microphone, whereupon the microphone detecting a cancellation error between the vibration noise and the control sounds, generates the error signal e(n) received by the first and second w-updating units.

17. The active vibration noise control device according to claim 16, wherein, the basic cosine wave x0(n) satisfies the equation x0(n)=A cos(ω0n+ϕ), where "A" indicates amplitude, and "ϕ" indicates an initial phase, the basic sine wave x0(n) satisfies the equation x0(n)=A sin(ω0n+ϕ), where the "A" indicates the amplitude, and the "ϕ" indicates the initial phase, the first adaptive notch filter adds a value obtained by multiplying the basic cosine wave x0(n) by the first filter coefficient w01(n) to a value by multiplying the basic sine wave x1(n) by the first filter coefficient w11(n), so as to calculate the control signal y1(n), and the second adaptive notch filter adds a value obtained by multiplying the basic cosine wave x0(n) by the second filter coefficient w02(n) to a value by multiplying the basic sine wave x1(n) by the second filter coefficient w12(n) so as to calculate the control signal y2(n), where the following equations are satisfied:

$$y1(n)=w01(n)x0(n)+w11(n)x1(n)$$

$$y2(n)=w02(n)x0(n)+w12(n)x1(n).$$

18. The active vibration noise control device according to claim 17, wherein, the first and second adaptive notch filters respectively generate the first control signal y1(n) to the first speaker and the second control signal y2(n) to the second speaker in order to make the first and second speakers output the control sounds so that the vibration noise generated by the vibration noise source is cancelled, and the first and second w-updating units update the filter coefficients used by the first and second adaptive notch filters based on the error signal so as to minimize the error signal e(n), and wherein the first phase difference and the second phase difference are preliminarily calculated by a measurement and/or a predetermined operational expression, and are stored in a storage unit.

* * * * *